US006943486B2

(12) United States Patent
Nittke et al.

(10) Patent No.: US 6,943,486 B2
(45) Date of Patent: Sep. 13, 2005

(54) ILLUMINATION UNIT

(75) Inventors: Andreas Nittke, Berheim (DE); Roland Stark, Wellheim (DE)

(73) Assignee: Osram Sylvania Inc., Danver, MA (US)

( * ) Notice: Subject to any disclaimer, the term of this patent is extended or adjusted under 35 U.S.C. 154(b) by 12 days.

(21) Appl. No.: 10/732,352

(22) Filed: Dec. 11, 2003

(65) Prior Publication Data

US 2004/0120154 A1 Jun. 24, 2004

(30) Foreign Application Priority Data

Dec. 19, 2002 (DE) ..... 102 60 129

(51) Int. Cl.[7] ..... H01J 1/02

(52) U.S. Cl. ..... 313/25; 313/17; 362/362; 362/376; 362/377

(58) Field of Search ..... 313/17, 25; 362/362, 362/376, 377

(56) References Cited

U.S. PATENT DOCUMENTS

| | | | | | |
|---|---|---|---|---|---|
| 1,042,565 | A | * | 10/1912 | Kroner | 313/25 |
| 1,637,864 | A | * | 8/1927 | Kolster | 313/50 |
| 3,602,759 | A | * | 8/1971 | Evans | 313/112 |
| 4,703,227 | A | * | 10/1987 | Takeda et al. | 313/634 |
| 4,949,003 | A | * | 8/1990 | Cox et al. | 313/25 |
| 6,406,167 | B1 | * | 6/2002 | Bock | 362/376 |

FOREIGN PATENT DOCUMENTS

DE 299 05 836 9/1999

* cited by examiner

*Primary Examiner*—Nimeshkumar D. Patel
*Assistant Examiner*—Anthony Perry
(74) *Attorney, Agent, or Firm*—William E. Meyer

(57) ABSTRACT

The invention relates to an illumination unit having an electric lamp which has a lamp vessel having a sealed-off end in the form of a glass base, and having an envelope which at least partially surrounds the lamp vessel and rests on the lamp vessel such that the glass base protrudes from the envelope.

1 Claim, 1 Drawing Sheet

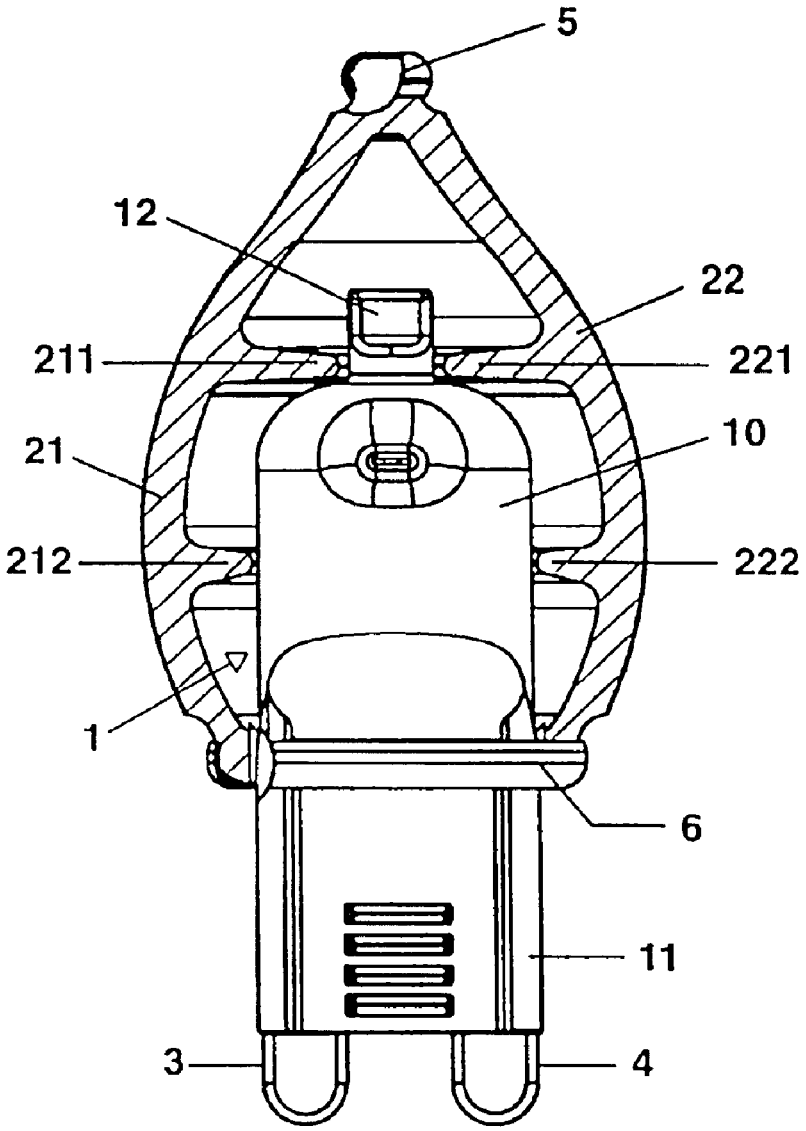
5
12
22
211
221
21
10
212
222
1
6
11
3
4

ILLUMINATION UNIT

TECHNICAL FIELD

The invention relates to an illumination unit comprising an electric lamp which has a lamp vessel (10) having a sealed-off end, an envelope fixed to the lamp, which at least partially surrounds the lamp vessel and which has an aperture for the lamp.

BACKGROUND ART

An illumination unit of this type has been disclosed, for example, in German utility model DE 299 05 836. This publication describes an illumination unit comprising a reflector, an incandescent lamp arranged therein and a reflector neck insert comprising two halves, which surrounds the sealed-off end of the lamp vessel and is fixed in the conically formed reflector neck with a clamping fit. The sealed-off end of the lamp vessel has two webs which respectively engage in grooves which are provided on each half of the reflector neck insert.

DISCLOSURE OF THE INVENTION

The object of the present invention is to propose an illumination unit, having an electric lamp and an envelope, which has improved fastening means for fastening the envelope and the lamp. The fastening means should in particular be configured such that the illumination unit does not require its own base or adapter, but that rather the lamp base is freely accessible and the illumination unit can be inserted into a lamp holder which is matched to the lamp base.

This object is achieved by an illumination unit having an electric lamp which has a lamp vessel having a sealed-off end, an envelope which is fixed to the lamp, which at least partially surrounds the lamp vessel and which has an aperture for the lamp, wherein the sealed-off end of the lamp vessel is in the form of a base which protrudes from the envelope through the aperture, and the envelope rests on the lamp vessel. Particularly advantageous refinements of the invention are described in the dependent patent claims.

The illumination unit according to the invention has an electric lamp having a lamp vessel, which has a sealed-off end in the form of a base, preferably in the form of a glass base, and an envelope which at least partially surrounds the lamp vessel, which rests on the lamp vessel and which is provided with an aperture from which the base protrudes. This means that the lamp base is freely available for a corresponding lamp holder and that the illumination unit according to the invention does not require an adapter or its own base. In addition, this allows the envelope to be fixed directly to the lamp vessel. In the simplest case, the envelope is fastened to the lamp vessel by means of a plug connection, without additional fastening means being used, between the lamp vessel and the envelope. In a particularly advantageous manner, the invention can be applied to high-voltage halogen incandescent lamps which are provided with a G9 base, have comparatively small dimensions and can be operated, without using voltage transformers, directly from the AC mains voltage.

The envelope advantageously has inwardly pointing webs which are supported on the lamp vessel. These webs act as spacers between the outside of the lamp vessel and the inside of the envelope. By providing the webs with a suitable form and dimensions, the position of the envelope on the lamp vessel can be fixed. In particular, the length of the webs is advantageously matched to the form of the lamp vessel. At least one web is preferably provided which rests on the end of the lamp vessel which is remote from the base and acts as a depth limit stop for the lamp in the envelope and thus determines the insertion depth or penetration depth of the lamp in the envelope. The webs are advantageously formed from the material of the envelope and are integral with the envelope. The envelope is preferably made of glass, for example of pressed glass, or of a transparent plastic. This allows for simple production of the envelope with its inwardly pointing webs. The envelope is preferably a transparent outer bulb which completely surrounds the lamp vessel apart from the base. The light emission, such as the light color or the preferred direction of the light emission, can be influenced by means of the outer bulb.

BEST MODE FOR CARRYING OUT THE INVENTION

The invention will be explained in more detail below with reference to a preferred exemplary embodiment.

The FIG. shows a schematic, partially sectioned side view of the preferred exemplary embodiment of the invention.

The illumination unit in this embodiment comprises a high-voltage halogen incandescent lamp 1, which can be operated without a voltage transformer from the AC mains voltage and which has an electrical power consumption of approximately 40 watt, and an outer bulb 2 which partially surrounds the lamp 1. The lamp 1 has a quartz glass lamp vessel 10 which is sealed in a gas-tight manner and is provided at one end with a glass base 11, in particular a standardized G9 base. Two U-shaped electrical contacts 3, 4 for supplying power to an incandescent filament enclosed in the lamp vessel 10 project from the glass base 11. The outer bulb 2 is formed from two identical half-shells 21, 22 made of pressed glass which are held together by means of a cap 5 and a ring 6. The outer bulb 2 has at one end an aperture from which the glass base 11 of the lamp 1 protrudes. The rest of the lamp vessel 10 is surrounded by the outer bulb 2. The two half-shells 21, 22 of the outer bulb 2 each have an integral, inwardly pointing first web 211, 221 which rests on the end of the lamp vessel 10 which is remote from the glass base 11. These first webs 211, 221 determine the insertion depth or penetration depth of the lamp 1 in the outer bulb 2. The length of the first webs 211, 221 is selected such that the rest of the exhaust tube 12 protruding from the abovementioned end of the lamp vessel 10 is arranged between these webs 211, 221. In addition, the two half-shells 21, 22 each have a further integral, inwardly pointing web 212, 222 which bears against the outside of the lamp vessel 10. The two abovementioned webs 212, 222 act as spacers and to align the outer bulb 2 with respect to the lamp vessel 10. The ring 6 is made of a metal, for example steel, and surrounds the two half-shells 21, 22 of the outer bulb 2 at the open end of the outer bulb 2 from which the glass base 11 protrudes. The two half-shells 21, 22 are held together at the opposite end by means of the cap 5 which likewise surrounds the two half-shells 21, 22 and covers the end of the outer bulb 2 opposite the glass base 11.

The invention is not limited to the exemplary embodiment described in more detail above. The outer bulb may also be integral and be produced, for example, from a transparent plastic. In this case, there is no need for a cap 5 or a ring 6. The outer bulb is in this case pushed onto the lamp vessel 10 in the manner of a cap or a hood, inwardly pointing webs which are formed from the material of the outer bulb and are integrally formed on the outer bulb being supported on the lamp vessel and acting as spacers. The plastic webs are configured and dimensioned such that the lamp vessel 10 is arranged between the webs with a clamping fit. In order to achieve the clamping fit, use is made of the material properties of the plastic. Instead of an outer bulb, the illumination unit according to the invention may also be fitted with a reflector.

What is claimed is:

1. An illumination unit having an electric lamp which has a lamp vessel having a sealed-off end, an envelope which is fixed to the lamp, which at least partially surrounds the lamp vessel and which has an aperture for the lamp, wherein the sealed-off end of the lamp vessel is in the form of a base which protrudes from the envelope through the aperture, and the envelope rests on the lamp vessel;

wherein the envelope has inwardly pointing webs which are supported on the lamp vessel, and wherein the webs are formed from the material of the envelope.

* * * * *

UNITED STATES PATENT AND TRADEMARK OFFICE

CERTIFICATE OF CORRECTION

PATENT NO. : 6,943,486 B2
APPLICATION NO. : 10/732352
DATED : September 13, 2005
INVENTOR(S) : Andreas Nittke and Roland Stark It is certified that error appears in the above-identified patent and that said Letters Patent is hereby corrected as shown below:

On the Title Page Item -73- The Assignee was inadvertently identified as "OSRAM SYLVANIA Inc." should read as --Treuhand-Gesellschaft für elektrische Glühlampen mbH--

Signed and Sealed this

Ninth Day of September, 2008

JON W. DUDAS
*Director of the United States Patent and Trademark Office*